United States Patent [19]

Minton

[11] 3,985,276

[45] Oct. 12, 1976

[54] GUIDE ROLL APPARATUS

[76] Inventor: Carl H. Minton, ADS Machinery Corp. P.O. Box 1027, Warren, Ohio 44482

[22] Filed: Aug. 21, 1975

[21] Appl. No.: 606,569

[52] U.S. Cl. ..... 226/21
[51] Int. Cl.[2] ..... B65H 25/26
[58] Field of Search ..... 226/21, 22, 23, 3, 18

[56] References Cited

UNITED STATES PATENTS

| | | | |
|---|---|---|---|
| 3,107,036 | 10/1963 | Richards | 226/22 X |
| 3,373,288 | 3/1968 | Otepka | 226/21 X |
| 3,682,362 | 8/1972 | Ott | 226/21 |
| 3,912,143 | 10/1975 | Miller | 226/21 X |

*Primary Examiner*—Richard A. Schacher
*Attorney, Agent, or Firm*—Michael Williams

[57] ABSTRACT

A guide roll apparatus for use in a metal strip processing line wherein it is desirable that the longitudinal centerline of the strip remains coincident with the centerline of the strip processing line.

The guideroll apparatus is compact in design so that it may be located in a strip processing line where prior steering rolls would not fit. The apparatus comprises a pair of rolls so disposed that the strip passes over a portion of one roll, then between the rolls and over a portion of the other roll, on its path of travel in the processing line. Each of the two rolls is mounted for tilting movement, and mechanism between the rolls causes the rolls to tilt in opposite directions in the same amount.

16 Claims, 16 Drawing Figures

10
13
25
29
35
38
41
43
44
50
51
52
53
54
55
56
57
58
59
60
61
70
71
72
73
74

GUIDE ROLL APPARATUS

BACKGROUND AND SUMMARY

The prior art is probably best disclosed in U.S. Pat. No. 3,610,494, issued to me on Oct. 5, 1971. Although the strip steering roll assembly shown in this patent operated satisfactorily, its uses were limited because of the relatively large amount of space it required.

My improved guide roll apparatus is extremely compact and therefore may be located practically anywhere in a strip processing line. The compactness results from the fact that a pair of guide rolls may be positioned closely together without sacrificing accuracy in strip control.

Each of the rolls is mounted for tilting movement relative to the plane of the strip, with tilting of one roll in one direction causing a corresponding tilting of the other roll in the opposite direction. The rolls tilt in opposite directions about an axis which coincides with the centerline of the strip and the line. Any deviation of the position of the strip from the centerline of the line is detected by photo cells which send an imbalance signal, proportional to the amount of deviation, to an electro-hydraulic relay. This relay directs hydraulic power to one end of a hydraulic cylinder which causes the rolls to tilt in a direction which will create a guiding effect to return the traveling strip to the centerline of the line. With this arrangement, both rolls simultaneously guide the strip laterally in the same direction, thereby requiring minimal tilt angle to achieve the degree of guiding necessary. The minimal tilt angle results in minimum additional stress in the strip edges. My improved guide roll assembly is particularly suited for use in a continuous anneal and pickle line, although it will be understood that this is merely an example and not a limitation.

DESCRIPTION OF THE DRAWINGS

In the drawings accompanying this specification and forming a part of this application, there is shown, for purpose of illustration, an embodiment which my invention may assume, and in these drawings.

DESCRIPTION OF THE PREFERRED EMBODIMENT

Figure 11:
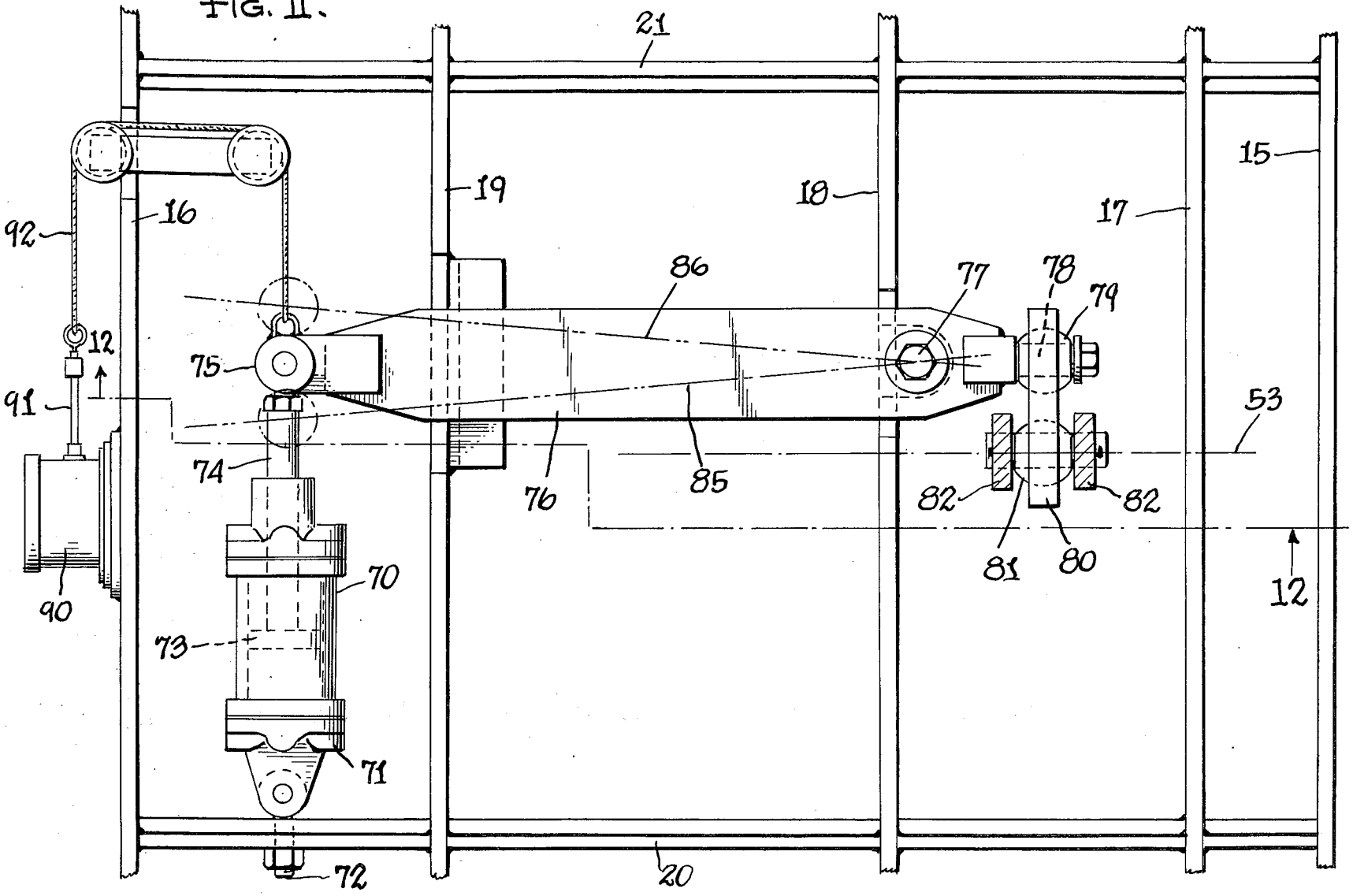
FIG. 11 is a sectional view corresponding generally to the line 11—11 of FIG. 12.
Figure 12:
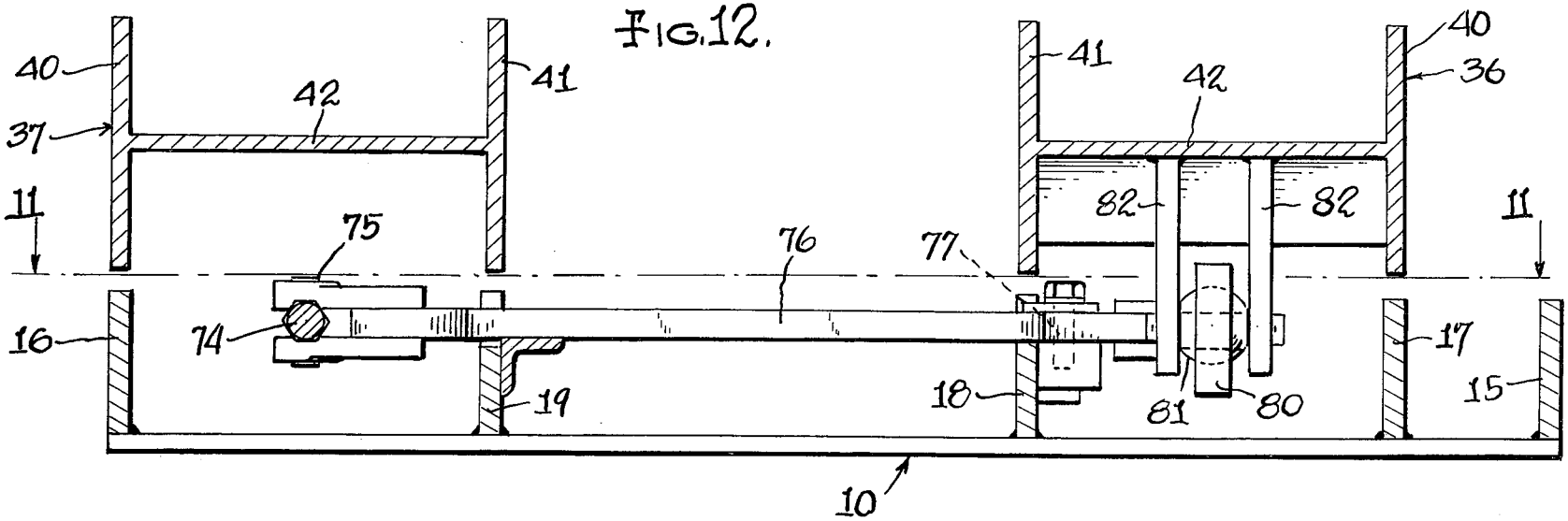
FIG. 12 is a sectional view corresponding generally to the line 12—12 of FIG. 11.

The preferred embodiment of my invention comprises a base 10 which may be a welded fabrication of a base plate 11, upstanding front and rear plates 12 and 14, and upstanding end plates 15 and 16. As best seen in FIG. 11, crossplates 17, 18, and 19 are welded between front and rear plates to provide rigidity in construction. To provide further rigidity, and anchorage for certain parts to be described, plates 20 and 21, designated as a whole but actually formed in sections as seen in FIG. 11, are welded crosswise of the plates 15, 16, 17, 18 and 19.

The base supports a pair of rolls 25, 26 of substantial diameter and length, as seen in the various views. Each roll may be formed as a welded fabrication, as suggested in FIG. 9, including a cylindrical drum 27 and side plates 28. Each roll has a shaft 29 extending centrally thereof and rigidly secured to it in any suitable manner, such as by welding the shaft to the opposite side plates 28.

Each shaft 29 is rotatably supported in a pair of pillow block bearings 35-35. The bearings for the shafts 29 are supported by respective cradles 36, 37. As best seen in FIGS. 1, 8, 10 and 12, each cradle comprises a pair of spaced plate sections 40, 41 which extend above and below a cross plate 42. Extending upwardly and forming a continuation of each plate section 40, 41 are respective narrower plate sections 43 and a perch plate 44 is welded across the tops of each pair of sections 43 to provide a support for respective pillow block bearings 35. Front plates 38 are welded across the plate sections 40 and 43 to close the same.

Figure 9:
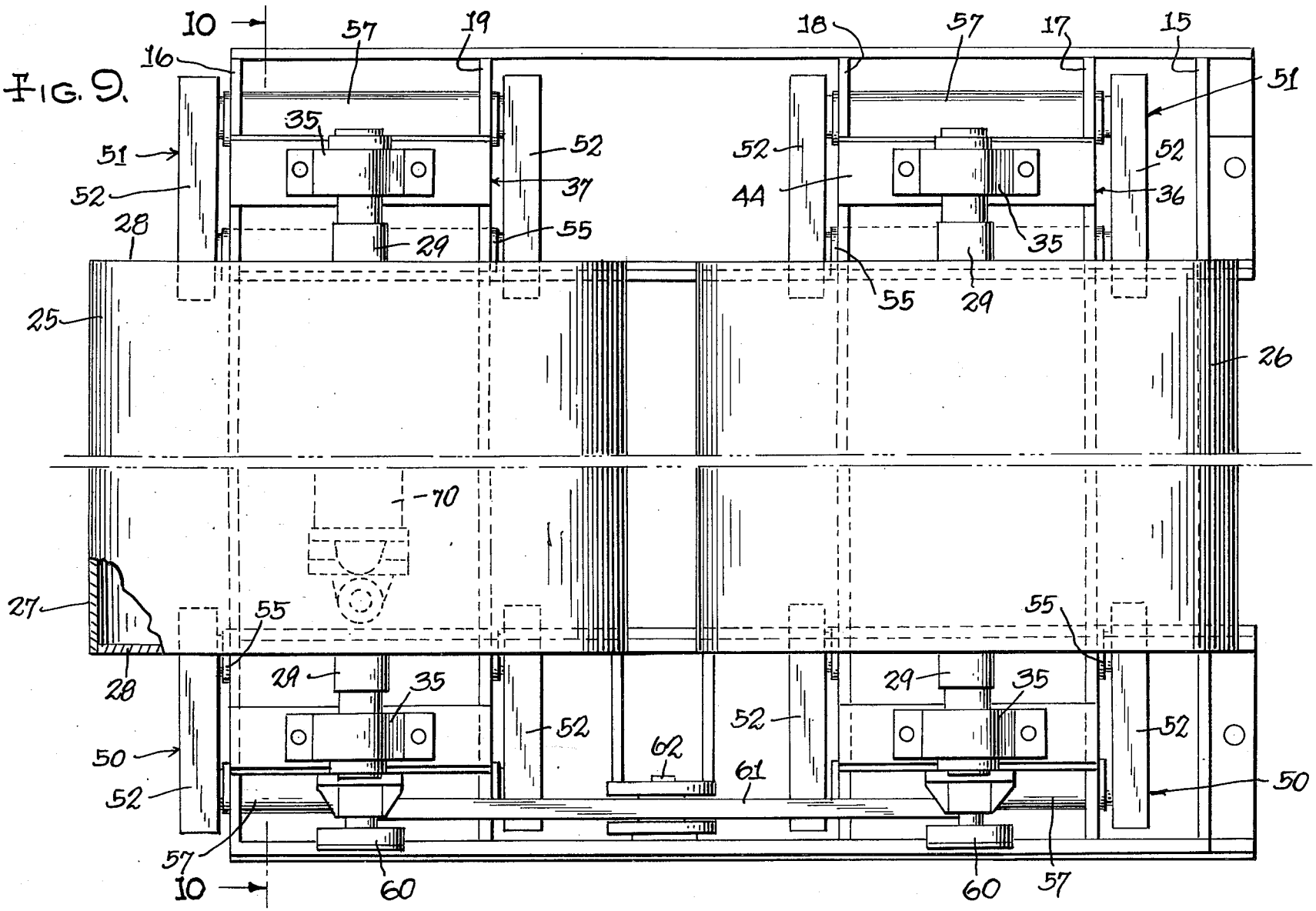
FIG. 9 is a top plan view thereof.
Figures 10, 15, 16:
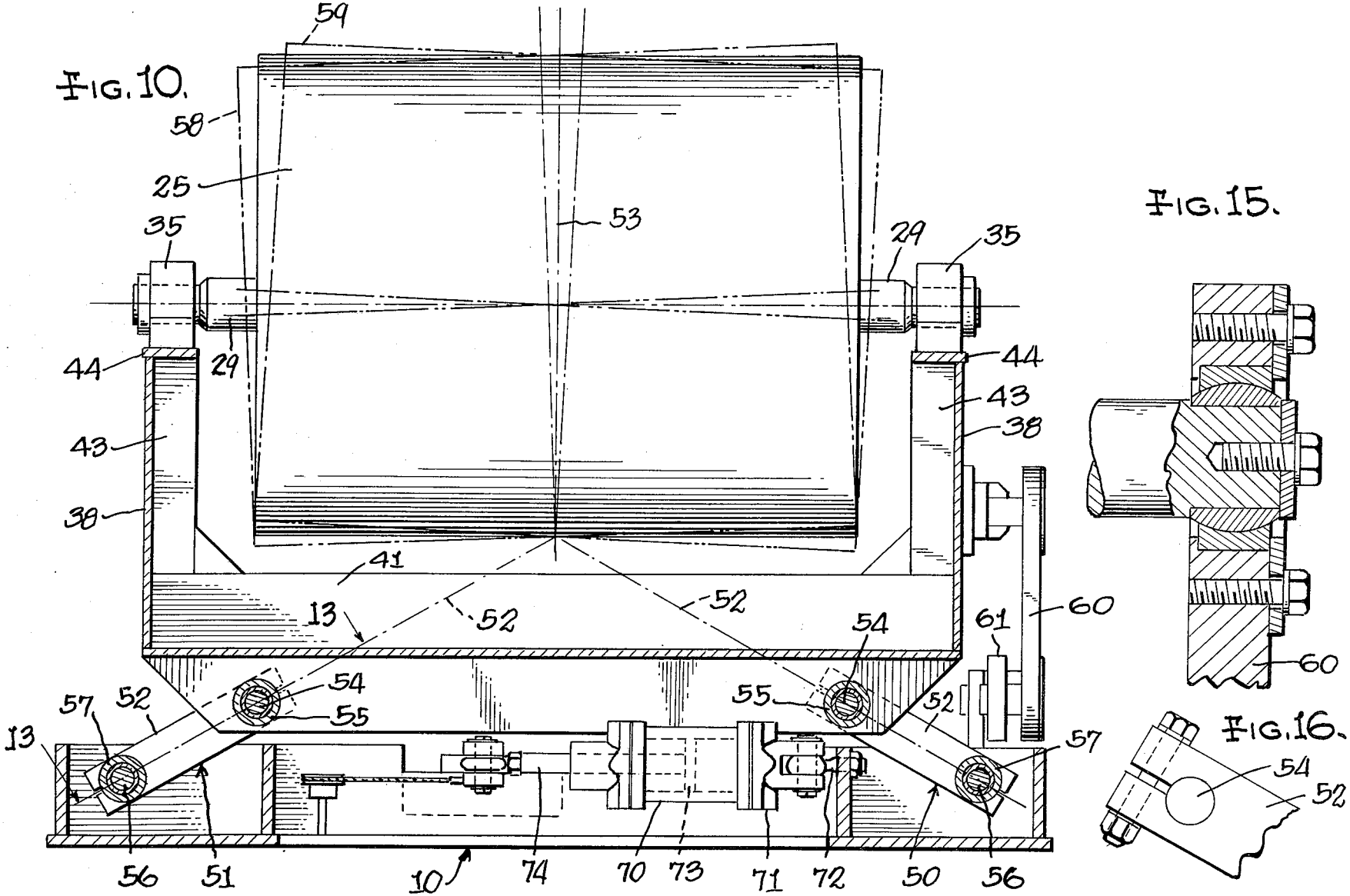
FIG. 10 is a section corresponding generally to the line 10—10 of FIG. 9.
FIG. 15 is an enlarged, fragmentary sectional view corresponding generally to the line 15—15 of FIG. 8.
FIG. 16 is a fragmentary side view of a detail.

Each cradle 36, 37 is supported in identical manner, for tilting movement relative to the base 10 and, as best seen in FIGS. 9 and 10, each support comprises front and rear pivot mechanisms 50 and 51 of identical construction. Each pivot mechanism comprises a pair of angularly disposed levers 52, 52 disposed outwardly of the plate sections 40, 41 of the cradle and normally along centerlines 52 which meet at the lowermost portion of a respective roll at the centerline 53, which is the centerline of the processing line.

Figure 13:
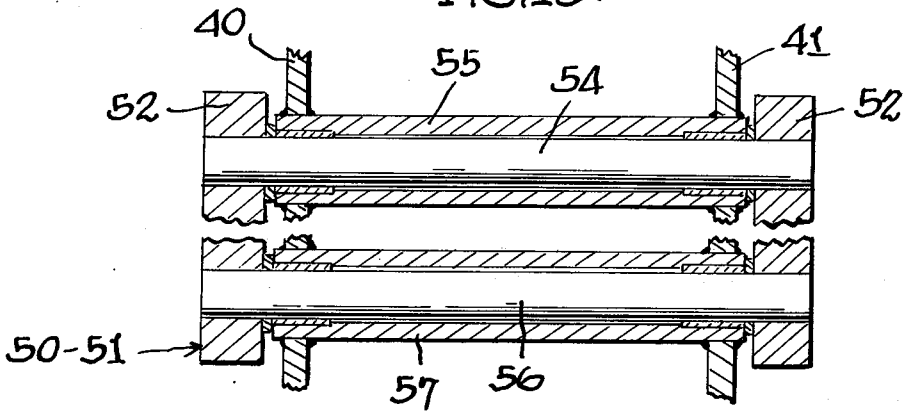
FIG. 13 is a broken sectional view corresponding generally to the line 13—13 of FIG. 10.

The upper end of each pair of levers 52 is rigidly secured to a cross shaft 54 in a manner shown in FIG. 16. The shaft 54 is journalled in bearings carried by a tubular housing 55 (see especially FIG. 13) which has its opposite ends extending through openings in respective plate sections 40, 41 of a cradle, and welded therein.

The lower end of each pair of levers 52 is rigidly secured to a cross shaft 56, also in the manner shown in FIG. 16. The shaft 56 is journalled in bearings carried by a tubular housing 57 which has its opposite ends extending through and welded into openings in cross plate 17 and cross plate 18, in the case of cradle 36, and end plate 16 and cross plate 19, in the case of cradle 37. The levers 52 support each cradle for tilting movement so that the rolls carried thereby may be tilted to opposite positions shown by the dot-dash lines 58 or 59 in FIG. 10, with the lowermost central portion of each roll remaining substantially aligned with the centerline 53 of the processing line.

Figure 1:
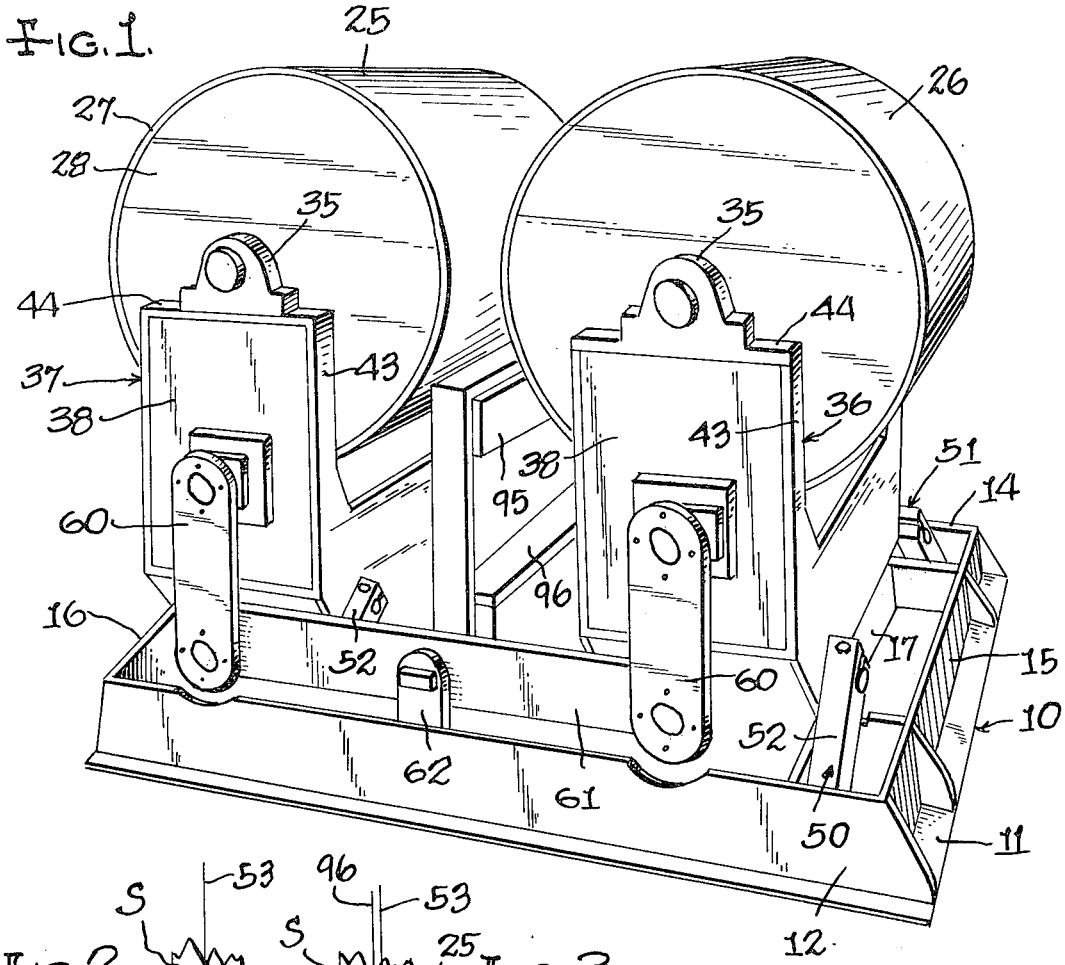
FIG. 1 is a perspective view of a guide roll apparatus, illustrating a preferred embodiment of my invention.
Figure 2:
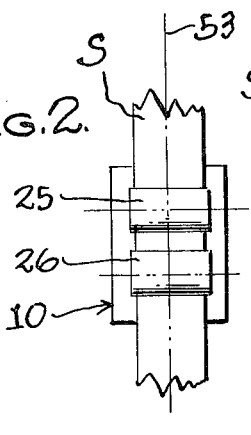
FIGS. 2 and 3 are schematic views illustrating the strip on and off center of the processing line.
Figure 8:
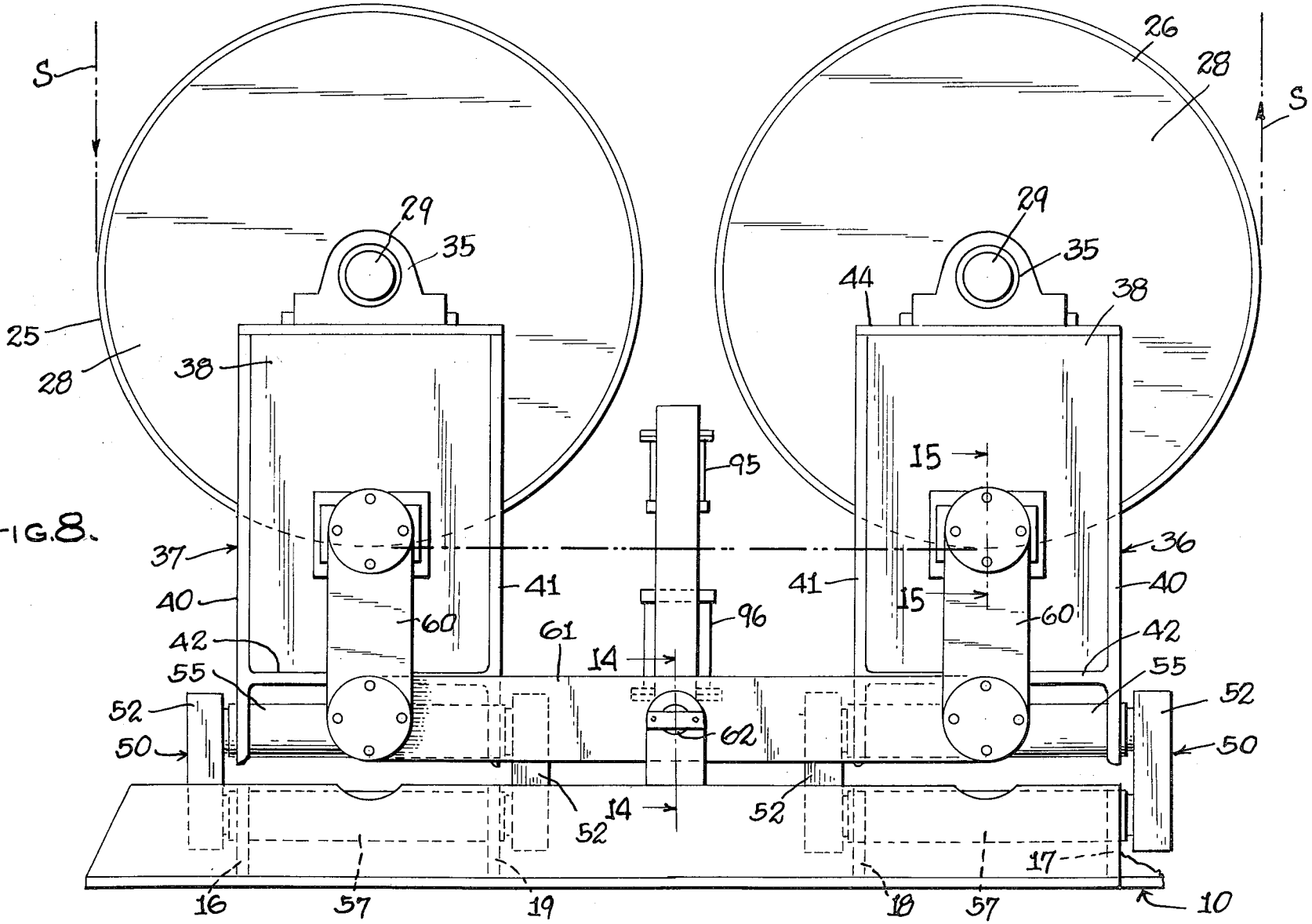
FIG. 8 is a side view of my improved guide roll apparatus.
Figure 14:
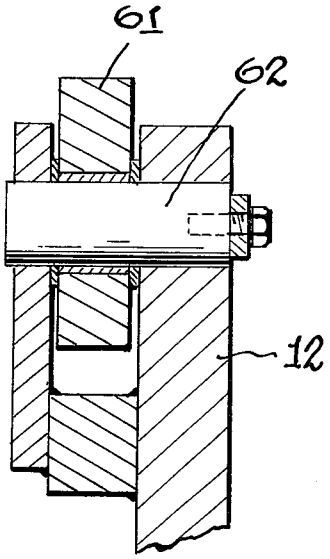
FIG. 14 is an enlarged, fragmentary sectional view corresponding generally to the line 14—14 of FIG. 8.

Mechanism is provided to cause tilting of the rolls in opposite direction and in corresponding amounts. As seen in FIGS. 1 and 8, the front side of cradles 36, 37 have the upper end of links 60 connected thereto by a ball-joint journal, the detail of which is seen in FIG. 15. The lower end of each link 60 has a similar ball-joint connection with a respective end of a rock link 61. The center portion of the link 61 is pivotally connected to the base 10 by a journal connection 62 shown in detail in FIG. 14.

Means are provided to cause proper tilting movement of the cradles 36, 37 and the rolls carried thereby in response to any deviation of the strip center from the centerline of the processing line. In the present disclosed embodiment, such means include a double acting cylinder 70 (see especially FIGS. 10 and 11) which may be of a commercially available type. The blank end 71 of the cylinder is pivotally connected to the eye of a stud 72 and the latter is held connected to a portion of base plate 20.

Under normal conditions, that is when the center of the strip is on the centerline of the processing line, the piston 73 is disposed midway of the ends of cylinder 70. The outer end of piston rod 74 has a clevis connection 75 with a horizontally disposed rock lever 76, and the latter is pivotally connected to crossplate 18 at 77. A stub shaft 78 is rigidly carried by the short end of rock lever 76 and has ball-joint connection 79 with a cross link 80. The link also has ball-joint connection 81 between a pair of fingers 82 which are welded to and extend downwardly from cross plate 42 of cradle 36.

The center of ball joint connection 81 is normally on the centerline of the processing line. However, should the center of the strip deviate from the centerline of the processing line, the piston 73 of cylinder 70 is driven in the proper direction to swing lever 76 toward one or the other positions shown in by dot-dash lines 85, 86 in FIG. 11. This will cause swinging movement of the short end of rock lever 76 and in turn cause tilting of the cradle 36 and its roll. Tilting movement of cradle 36 will be transmitted to its link 60, to the rock link 61, and in turn to the link 60 of cradle 37 to tilt the latter and its roll in a direction opposite to that of cradle 36, but in the same amount.

As best seen in FIG. 11, a transducer 90 is welded to the base 10 and has its operating member 91 connected by a cable 92 to the clevis connection 75. The transducer 90 may be of commercially available construction, and operates in well-known manner to provide a reference signal for the control circuit of the apparatus to prevent excessive movement of the rock lever 76 and resultant hunting of the same. The transducer may be of the type sold by the North American Manufacturing Company.

The position of the stripS relative to the center line of the processing line is detected in well known manner by an edge detector 95 and a light source 96, spaced as shown in FIG. 8, so that the strip between rolls passes therethrough. Both edge detector and light source are commercially available. The edge detector may be that sold by North American, Model H 3046, and the light source may be that sold by North American, Model H 3060.

Figure 3:
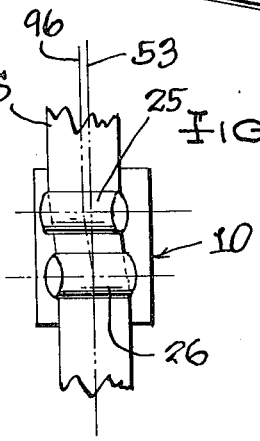
Figure 7:
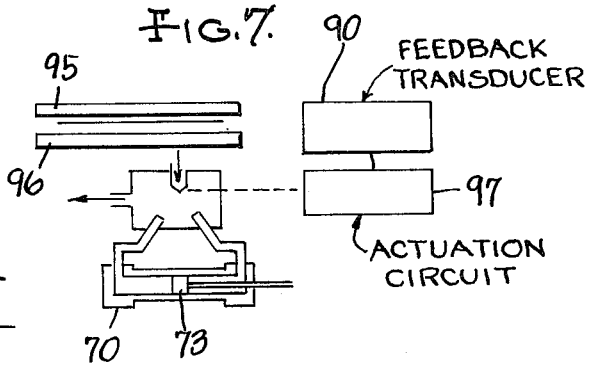
FIG. 7 is a schematic view of control mechanism utilized to control guide roll tilting.

In the event the strip S entering the guide roll apparatus deviates from the centerline 53 of the processing line, as shown by line 96 in FIG. 3, a signal indicating the direction and amount of deviation is produced by the edge detector 95 and is applied to an actuation circuit 97 (see FIG. 7). The feedback transducer 90 also supplies a signal to the actuation circuit 97 which is related to the position of the rock lever 76 relative to the centerline of the processing line. The actuation circuit will cause operation of the cylinder 70 to move the rock lever 76 a predetermined amount and thereby cause opposite tilting of the rolls 25 and 26, as seen in FIG. 3, to return the strip S to the centerline of the processing line.

Figure 4:
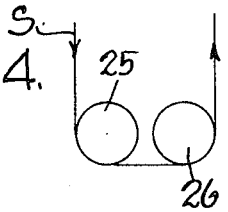
FIGS. 4, 5, and 6 are diagrammatic views showing various ways in which the strip may travel with respect to the guiderolls.
Figure 5:
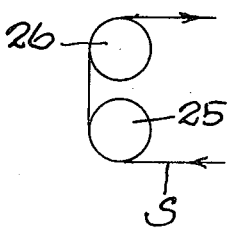
Figure 6:
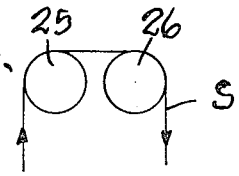

FIG. 4 shows diagramatically the path of the strip about the rolls in the embodiment hereinbefore described. The strip may enter and leave the rolls in various other ways, such as for example as shown in FIGS. 5 and 6, it being evident that the guide structure will be disposed to accommodate such strip movement.

I claim:

1. Roll guide apparatus insertable within a strip processing line for correcting deviation of a running strip from the longitudinal centerline of said line, comprising:

a base, a pair of cradles carried by said base, each cradle having spaced bearings, a pair of rolls, each having a shaft journalled in the bearings of a respective cradle, said strip being adapted to run flatwise over a portion of one roll, between said rolls and over a portion of the other roll, link means pivotally connecting each cradle with said base for tilting movement, rocker link means pivotally connected intermediate its ends to said base, a pair of link means, each having one end pivotally connected to a respective cradle and its other end pivotally connected to a respective end of said rocker link means, whereby tilting of one cradle in one direction causes tilting of the other cradle in an opposite direction, a fluid cylinder having a blank end connected to said base and its piston rod connected to one of said cradles, predetermined actuation of said cylinder causing said cradles to tilt in predetermined directions, and a strip edge detector disposed between said rolls and affected by the disposition of the strip therebetween, said edge detector being operable to detect deviation of strip from the centerline of said strip processing line and to send a signal to effect operation of said fluid cylinder.

2. The construction according to claim 1 wherein the axis of said rolls are held in parallelism, the axis of each roll being held within and lengthwise along a plane which is normal to the flat side of that part of the stip running between said rolls, and wherein tilting movement of said cradles tilts said roll axes in said planes.

3. The construction according to claim 1 wherein the tilting action of each roll axis is about a point coincident with the centerline of said strip processing line.

4. Roll guide apparatus insertable within a strip processing line for correcting deviation of a running strip from a predetermined longitudinal line of said strip processing line, comprising:

a base, a pair of rotatable rolls carried by said base, the axes of rotation of said rolls lying within respective ones of two spaced planes which are in parallel relation, said strip being adapted to run flatwise over a peripheral portion of one roll, between said rolls in a plane transverse to said two spaced planes and over a peripheral portion of the other roll in its path of travel in said processing line, said rolls being normally within position wherein the axis of rotation of both rolls lie within a single plane which is transverse to said two spaced planes, and means for tilting the axis of each roll within a respective one of said two spaced planes and to displace the axis of rotation of each roll from said single plane in a manner to move opposite ends of the roll in opposite directions.

5. The constuction according to claim 4 wherein the axis of each roll is tilted about a point located intermediate the opposite ends of the roll and substantially at the periphery of a respective roll.

6. The construction according to claim 5 wherein the roll axes are tilted simultaneously in opposite directions.

7. The construction according to claim 4 wherein said predetermined longitudinal line is the centerline of said strip processing line, said centerline lying within a further plane disposed between opposite ends of said rolls and transverse to said two spaced planes, the axis of each roll being tilted about a point disposed within said further plane.

8. The construction according to claim 5 wherein the point of tilt is located at the place of contact of that part of the strip extending between said rolls with each of said rolls.

9. Roll guide apparatus insertable within a strip processing line, a base, a pair of rotatable rolls, a pair of cradles in spaced side-by-side relation, each cradle independently supporting a respective one of said rolls, each cradle having spaced side portions for receiving a roll therebetween, said side portions fixedly supporting bearings for journalling shaft portions extending from opposite ends of said roll, the construction being such that each roll is fixed for movement with its related cradle but is rotatable about an axis defined by its shaft portions, said strip being adapted to run flatwise over a peripheral portion of one roll, between said rolls and over a peripheral portion of the other roll in its path of travel in said processing line, means connecting respective cradles to said base in position wherein the axis of rotation of said rolls lie within respective ones of two spaced planes which are in parallel relation, said connecting means providing for tilting movement of each of said cradles and tilting of the axis of the roll carried thereby within its respective plane, and further connection means between said cradles for translating tilting movement of one to the other.

10. The construction according to claim 9 wherein said first named connection means comprises link means having opposite ends pivotally connected to a cradle and said base.

11. The constuction according to claim 9 wherein said roll guide apparatus is adapted to correct deviation of a running strip from the longitudinal centerline of said processing line, said centerline being disposed in a plane which is transverse to said two spaced planes and which passes through both rolls intermediate the ends thereof, and a pair of links for each cradle, each link having its opposite ends pivotally connected to a cradle portion and said base, said links being spaced apart and inclined toward each other.

12. The constuction according to claim 11 wherein a line through the pivot connections of each link intersects the plane of said centerline at substantially a peripheral portion of the respective roll.

13. The construction according to claim 11 wherein a rock link is connected to said base by a pivot connection intermediate its ends, and a pair of connection links, each having one end connected to a respective cradle by a ball joint connection and its opposite end pivotally connected to a respective end of said rock link, whereby tilting movement of one cradle is translated to opposite tilting movement of the other cradle.

14. The construction according to claim 13 wherein the pivot connection of said rock link to said base is equidistant with respect to the pivot connection with each connection link, and each of the latter being of equal length.

15. The construction according to claim 11 wherein a strip edge detector is disposed between said rolls and affected by the disposition of the strip travelling between said rolls, said strip edge detector being operable to detect deviation of the strip from the centerline of said strip processing lines and to send a signal to operate means for effecting tilting movement of said cradles.

16. The construction according to claim 11 wherein said means for effecting tilting movement of said cradles includes a fluid cylinder, the operation of which is dependent upon the signal sent by said strip edge detector.

* * * * *